US007321278B2

(12) United States Patent
Vangala

(10) Patent No.: US 7,321,278 B2
(45) Date of Patent: Jan. 22, 2008

(54) LOW PROFILE CERAMIC RF FILTER INCLUDING TRAP RESONATORS AND A DECOUPLER

(75) Inventor: Reddy Vangala, Albuquerque, NM (US)

(73) Assignee: CTS Corporation, Elkhart, IA (US)

( * ) Notice: Subject to any disclaimer, the term of this patent is extended or adjusted under 35 U.S.C. 154(b) by 126 days.

(21) Appl. No.: 10/550,523

(22) PCT Filed: Apr. 7, 2004

(86) PCT No.: PCT/US2004/010526

§ 371 (c)(1),
(2), (4) Date: Sep. 22, 2005

(87) PCT Pub. No.: WO2004/093239

PCT Pub. Date: Oct. 28, 2004

(65) Prior Publication Data

US 2006/0192634 A1 Aug. 31, 2006

Related U.S. Application Data

(60) Provisional application No. 60/460,970, filed on Apr. 7, 2003.

(51) Int. Cl.
*H01P 1/213* (2006.01)
*H01P 1/205* (2006.01)

(52) U.S. Cl. ..... 333/134; 333/202; 333/206

(58) Field of Classification Search ..... 333/134, 333/202, 206

See application file for complete search history.

(56) References Cited

U.S. PATENT DOCUMENTS

| | | | | |
|---|---|---|---|---|
| 5,109,536 | A | 4/1992 | Kommrusch | |
| 5,929,721 | A * | 7/1999 | Munn et al. | 333/134 |
| 6,828,883 | B1 * | 12/2004 | Kitajima et al. | 333/206 |
| 2003/0201848 | A1 * | 10/2003 | Bloom et al. | 333/206 |
| 2003/0231080 | A1 | 12/2003 | Katsumi et al. | |

FOREIGN PATENT DOCUMENTS

| | | |
|---|---|---|
| EP | 959 518 A | 11/1999 |
| EP | 1 001 479 A | 5/2000 |
| EP | 1 249 887 A | 10/2000 |

* cited by examiner

*Primary Examiner*—Benny Lee
(74) *Attorney, Agent, or Firm*—Steven Weseman; Daniel J. Deneufbourg; Mark P. Bourgeois

(57) ABSTRACT

A low profile ceramic filter for connection to an antenna, a transmitter and a receiver. The filter filters an incoming signal from the antenna to the receiver and an outgoing signal from the transmitter to the antenna. The filter has a ceramic core with through-holes that extend between sides of the core. The through-holes form coupled resonators and trap resonators. Two trap resonators are located at ends of the block, and two of the trap resonators are located in a central portion of the block. The coupled resonators are located between the end trap resonators and the trap resonators in the central portion. The trap resonators have a resonant frequency that is outside of the desired passband such that trap zeros or poles are provided.

12 Claims, 5 Drawing Sheets

LOW PROFILE CERAMIC RF FILTER INCLUDING TRAP RESONATORS AND A DECOUPLER

CROSS-REFERENCE TO RELATED APPLICATION

This application is the U.S. national stage application of PCT Application Ser. No. PCT/US04/010526 filed on Apr. 7, 2004 and claims the benefit of U.S. Provisional Application No. 60/460,970 filed on Apr. 7, 2003 and incorporated herein by reference in its entirety.

TECHNICAL FIELD

This invention relates to dielectric block filters for radio-frequency signals, and in particular, to monoblock multi-passband filters.

BACKGROUND

Ceramic block filters offer several advantages over lumped component filters. The blocks are relatively easy to manufacture, rugged, and relatively compact. In the basic ceramic block filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the resonator holes.

One of the two opposing sides containing through-hole openings is not fully metallized, but instead bears a metallization pattern designed to couple input and output signals through the series of resonators. This patterned side is conventionally labeled the top of the block, though the "top" designation may also be applied to the side opposite the surface mount contacts when referring to a filter in the board-mounted orientation. In some designs, the pattern may extend to sides of the block, where input/output electrodes are formed.

The reactive coupling between adjacent resonators is affected, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel undesired coupling between non-adjacent resonators and other components of the RF application device.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels.

Coupled with the higher frequencies and crowded channels are the consumer market trends towards ever smaller wireless communication devices (e.g. handsets) and longer battery life. In particular, wireless device designers are concerned with reducing the board height, i.e. required clearance, of wireless components such as filters. Technologies now competing with monoblock ceramic filters such as film bulk acoustic resonators (FBAR) in some cases offer reduced board height requirements. These technologies are relatively more expensive, however.

Accordingly, this invention pertains to providing smaller monoblock ceramic filters without sacrificing filtering performance.

SUMMARY OF THE INVENTION

This invention overcomes problems of the prior art by providing a multi-passband ceramic block RF filter having a lower required board height but low passband insertion loss.

The present invention provides a communication signal filter adapted for connection to an antenna, a transmitter and a receiver. The filters are suitable for filtering an incoming signal from the antenna to the receiver and an outgoing signal from the transmitter to the antenna. Accordingly, the filters are suitable for providing a receiver signal passband and a transmit signal passband.

A communication filter according to the present invention includes a dielectric block having a first and a second end portion and a central portion therebetween. On the dielectric block are provided a first and a second antenna coupling pad, a transmitter coupling pad and a receiver coupling pad. A plurality of coupled resonators extend through the block. A trap resonator extends through the block and is located in the central portion between the first and the second antenna coupling pads such that the trap resonator provides increased attenuation outside of the desired passbands.

Such filters preferably include one or more additional trap resonators extending through the block and located at an end portion.

The filter's core of dielectric material has a first end, a second end, a top surface, a bottom surface and defines a plurality of through-holes, each extending between an opening on the top surface and an opening on the bottom surface. The surfaces of the core have a plurality of metallized areas. The metallized areas include a first input-output coupling area, a second input-output coupling area spaced apart from the first input-output coupling area along a length of the core between the first and second ends, a third input-output coupling area positioned between the first input-output coupling area and the first end, and a fourth input-output coupling area positioned between the second input-output coupling area and the second end.

The metallized areas also include a relatively expansive area. The relatively expansive area extends contiguously from the sidewall of the through-holes towards both the top surface and bottom surface of the core. The expansive area continues from within the through-holes over the bottom surface and the side surfaces of the core.

The first and second input-output coupling areas are spaced apart from each other but positioned toward the central portion of the block. The third and fourth input-output coupling areas are positioned towards the first and second ends of the block, respectively.

In a preferred embodiment, the first and second coupling areas are for connection to a communication device antenna, and the third and fourth coupling areas are for connection to a communication device transmitter and receiver, respectively.

The core configuration and the plurality of metallized areas together define a series of resonators including at least one through-hole resonator positioned between the first input-output coupling area and the second input-output coupling area. This centrally located resonator increases attenuation outside of the desired passbands.

The core and metallized areas together also define a decoupler between the first and second input-output coupling areas. The decoupler is preferably one of the plurality of through-holes having a metallized sidewall that is conductively connected to the expansive area at both the top surface and the bottom surface.

In a preferred embodiment, the communication filter includes four trap resonators. First and second trap resonators are provided on opposite sides of the decoupler and between the first and second input-output coupling areas. A third trap resonator is provided adjacent the third input-output coupling area, between the third coupling area and the first end of the block. A fourth trap resonator is likewise provided adjacent the fourth input-output coupling area, between the fourth coupling area and the second end of the block.

BRIEF DESCRIPTION OF THE FIGURES

In the Figures.

DETAILED DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
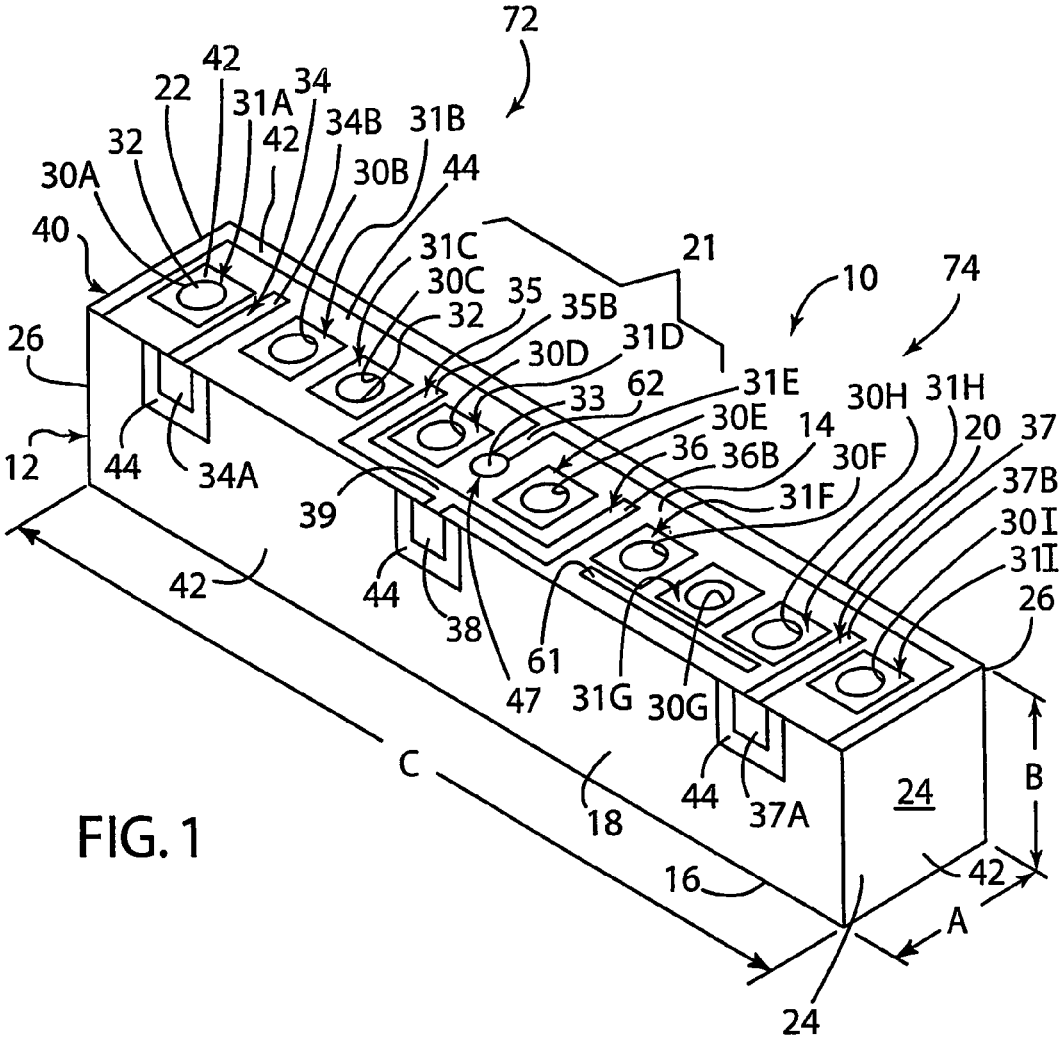
FIG. 1 is an enlarged perspective view of a duplexing filter according to the present invention.
Figure 2:
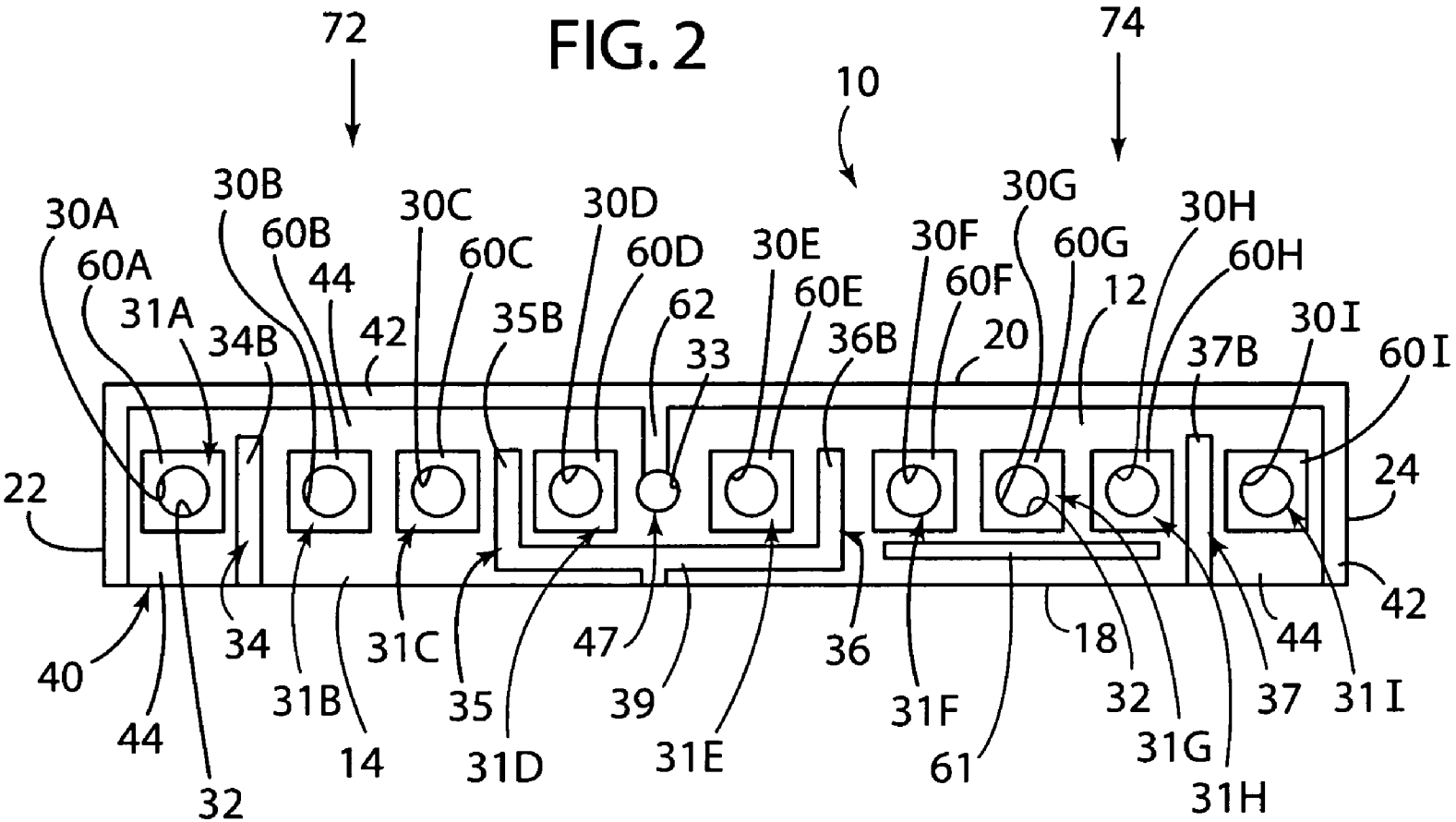
FIG. 2 is an enlarged top view of the filter of FIG. 1.

Referring to FIGS. 1 and 2, an antenna duplexer or RF filter 10 includes an elongate, parallelepiped (or "box-shaped") core of ceramic dielectric material 12. Core 12 has three sets of opposing side surfaces: a top 14 and a bottom 16 (FIG. 1), opposing long sides 18 and 20, and opposing narrow ends or sides 22 and 24. Core 12 has a central portion 21 as shown in FIG. 1. The interface between sides 18, 20, 22 and 24 define parallel edges 26 (FIG. 1). Core 12 has a length C, width B and height A, the designations of which appear in FIG. 1.

Core 12 defines a series of through-hole passageways 30A, 30B, 30C, 30D, 30E, 30F, 30G, 30H, 30I and 33, which each extend between openings on top surface 14 and bottom surface bottom 16. Through-holes 30A and 301 are located at ends 22 and 24. Through-holes 30D, 30E and 33 are located in central portion 21.

Core 12 is rigid and is preferably made of a ceramic material selected for mechanical strength, dielectric properties, plating compatibility, and cost. The preparation of suitable dielectric ceramics is described in U.S. Pat. No. 6,107,227 to Jacquin et al. and U.S. Pat. No. 6,242,376, the disclosures of which are hereby incorporated by reference to the extent they are not inconsistent with the present teachings. Core 12 is preferably prepared by mixing separate constituents in particulate form (e.g., $Al_2O_3$, $TiO_2$, $Zr_2O_3$) with heating steps followed by press molding and then a firing step to react and inter-bond the separate constituents.

Filter 10 includes a pattern of metallized and unmetallized areas (or regions) 40. Pattern 40 includes an expansive, relatively wide area of metallization 42 and an unmetallized area 44. Pattern 40 also includes multiple input-output coupling metallized areas 34, 35, 36 and 37. Specifically, pattern 40 has a transmitter coupling area 34, a receiver metallized coupling area 37, a first antenna input-output coupling area 35, and a second antenna input-output coupling area 36. Coupling areas 34 and 37 have corresponding surface mounting pads 34A and 37A on side surface 18 as shown in FIG. 1 and corresponding, respective extensions 34B and 37B onto top surface 14.

First and second antenna coupling areas 35 and 36 are preferably conductively linked to each other and a surface mount pad 38 (FIG. 1) by an interconnection area 39 of metallization. Coupling areas 35 and 36 have corresponding extensions 35B and 36B.

Pads 34A, 37A and 38 are provided for connecting filter 10 to other circuit elements of an electronic device in a surface-mount configuration. Accordingly, the dimension identified with the reference "A" in the figures is the surface-mount height, i.e. board profile, of the filter.

Expansive metallized area 42 covers portions of top surface 14 and side surface 18, and substantially all of bottom surface 16, side surfaces 20, 22, 24 and the sidewalls 32 (FIG. 1) of through-holes 30. Expansive metallized area 42 extends contiguously from within the resonator holes 30 towards both top surface 14 and bottom surface 16. Area 42 serves as a local ground.

Core 12 and pattern 40 together form the series of through-hole resonators 31A, 31B, 31C, 31D, 31E, 31F, 31G, 31H and 31I. Resonator pads 60A, 60B, 60C, 60D, 60F, 60G, 60H and 60I are located on top surface 14 as shown in FIG. 2 and are a portion of metallized area 42 and connected to metallization on sidewalls 32.

A key feature of the present invention is the presence of at least one centrally located trap resonator. Filter 10 includes two centrally positioned trap resonators, 31D and 31E. Both resonators 31D and 31E are located between the first and second antenna coupling areas 35 and 36. As used herein to describe the relative position of through-holes, resonators and metallized areas, the term "between" is a reference to the substantial alignment of features of the filter over the length C of the block between end 22 and end 24. For example, the position of through-hole 30A is between surface mount pad 34A and end 22 even though pad 34A is offset (on side 18) from the series of through-holes 30. Furthermore, the alignment of features described using the term "between" may include a reasonable amount of overlap.

A decoupler 47 is provided between through-holes 30D and 30E to reduce inductive and other electromagnetic coupling between resonators 31D and 31E. Decoupler 47 is provided in the form of a through-hole 33 having a metallized side wall connected to wide area 42 at bottom surface 16 and at top surface 14. Metallized through-hole 33 is connected to wide area 42 at top surface 14 by a metallization extension 62. Described in other words, doubly-connected metallized through-hole 33 creates a band of wide area 42 extending through the central portion of core 12.

The trap resonators 31D and 31E are tuned to provide a resonate response at a frequency outside desired filter passbands. By placing the trap resonators outside the frequency passband of interest, additional "zeros" or poles of attenuation are created which offer greater design flexibility and latitude, and a desirable frequency response.

Filter 10 preferably also includes a trap resonator towards end surfaces 22 and 24. Through-holes 30A and 30I form trap zeros or trap resonators 31A and 31I. Trap resonator 31A is positioned between and adjacent to both transmitter coupling area 34 and core end surface 22. Trap resonator 31I is likewise positioned between but adjacent to both receiver coupling area 37 and core end surface 24.

Resonators 31B and 31C are electromagnetically coupled and positioned between transmitter coupling area 34 and first antenna coupling area 35. Resonators 31F, 31G and 31H are electromagnetically coupled and positioned between receiver coupling area 37 and second antenna coupling area 36.

Pattern 40 also includes an isolated metallized area 61 on top surface 14 in the shape of a bar or strip extending over the length of core 12 adjacent to resonator pads 60F, 60G and 60H.

The unmetallized area 44 is present on portions of top surface 14 and side surface 18. Unmetallized area 44 substantially surrounds (or circumscribes) the resonator pads 60A, 60B, 60C, 60D, 60E, 60F, 60G, 60H and 60I. Unmetallized area 44 also circumscribes transmitter coupling area 34, first and second antenna coupling areas 35 and 36, receiver coupling area 37, and strip-shaped area 61.

For ease of description, duplexer filter 10 can be divided at through-hole 33 into two sections of resonators 31, a transmitter section 72 and a receiver section 74. Transmitter section 72 extends between first antenna coupling area 35 and end 22, while receiver section 74 extends in the opposite direction between second antenna coupling area 36 and end 24. Each section includes a plurality of resonators 31 and a respective input/output coupling area. More specifically, transmitter section 72 includes a transmitter coupling area 34, and receiver section 74 includes a receiver coupling area 37.

The metallized areas of pattern 40 preferably comprise a coating of one or more layers of a conductive metal. A silver-bearing conductive layer is presently preferred. Suitable thick film silver-bearing conductive pastes are commercially available from The Dupont Company's Microcircuit Materials Division.

The surface-layer pattern of metallized and unmetallized areas 40 on core 12 is preferably prepared by providing a rigid core of dielectric material, including through-holes, to predetermined dimensions. The outer surfaces and through-hole sidewalls are coated with one or more metallic film layers by dipping, spraying or plating.

The pattern of metallized and unmetallized areas is then preferably completed by computer-automated laser ablation of designated areas on core 12. This laser ablation approach results in unmetallized areas which are not only free of metallization but also recessed into the surfaces of core 12 because laser ablation removes both the metal layer and a slight portion of the dielectric material.

Alternatively, selected surfaces of the fully metallized core precursor are removed by abrasive forces such as particle blasting, resulting in one or more unmetallized surfaces. The pattern of metallized and unmetallized areas is then completed by pattern printing with thick film metallic paste.

Filters according to the present invention are optionally equipped with a metallic shield positioned across top surface 14. For a discussion of metal shield configurations, see U.S. Pat. No. 5,745,018 to Vangala. The filters are typically later soldered to a printed circuit board that contains an RF transmitter, receiver and an antenna as in a cell phone, for example.

Figure 3:
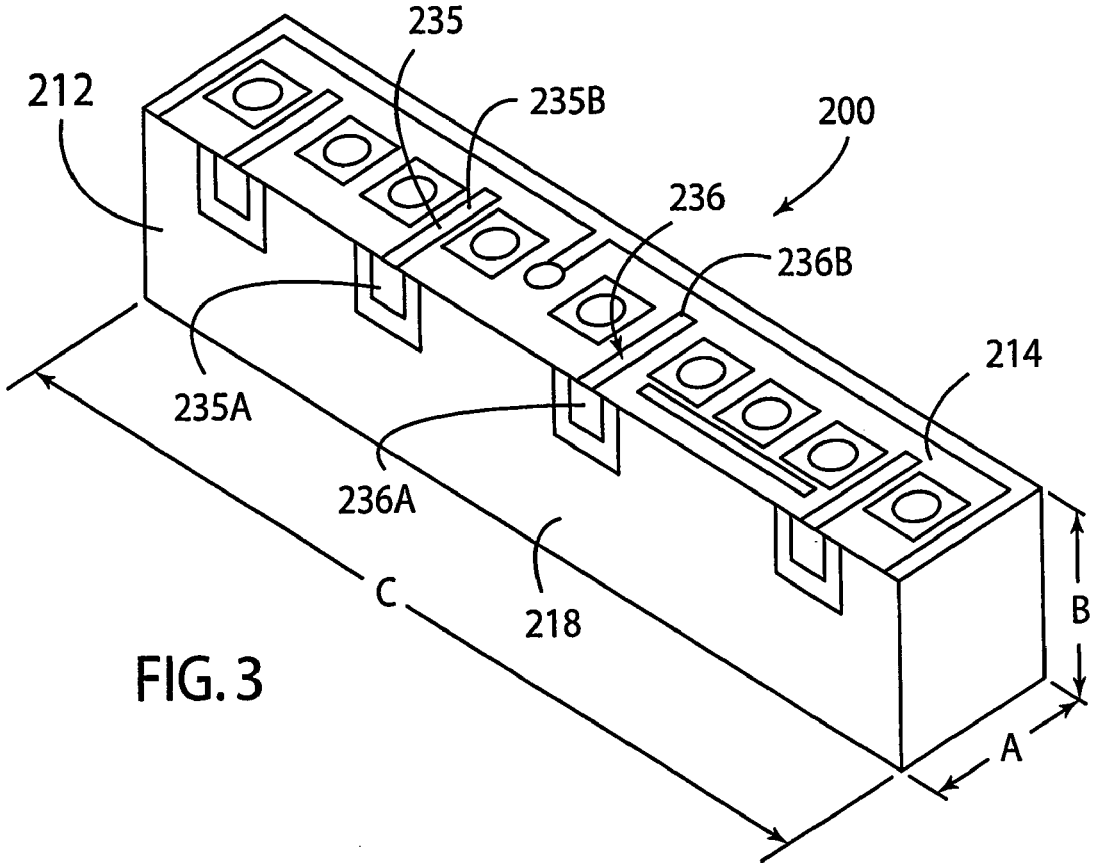
FIG. 3 is an enlarged perspective view of another embodiment of a duplexing filter.
Figure 4:
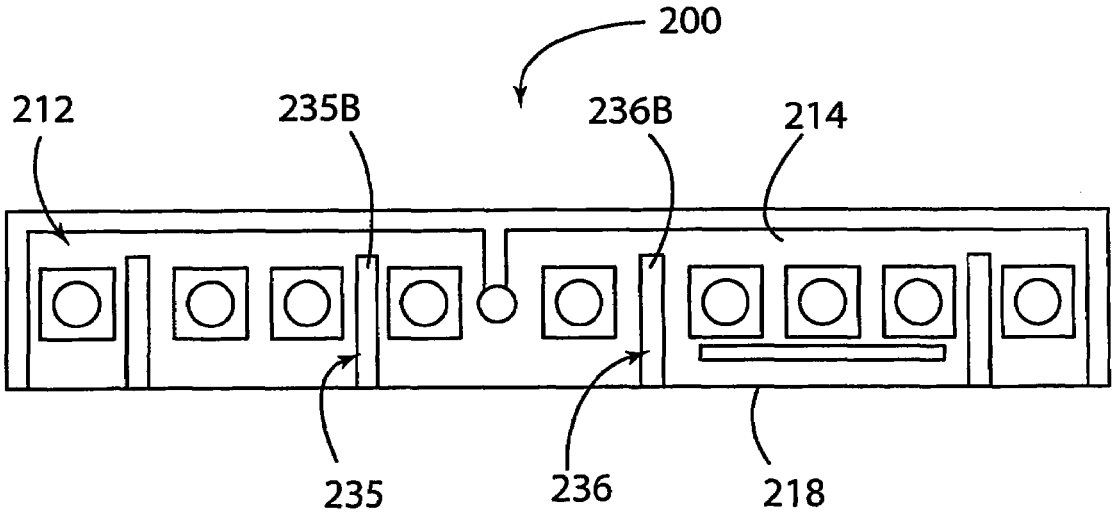
FIG. 4 is an enlarged top view of the filter of FIG. 3.

An alternative embodiment of an antenna duplexer or RF filter 200 is shown in FIGS. 3 and 4. RF filter 200 is similar to RF filter 10 except that first and second antenna coupling areas 235 and 236 are not conductively linked by metallization on the surface of core 212. First antenna coupling area 235 has a surface-mount pad 235A on side 218 and an extension 235B onto top surface 214. Second antenna coupling area 236 likewise has a surface mounting pad 236A and an extension 236B (FIG. 2) onto top surface 214. Surface mount pads 235A and 236A are preferably electrically interconnected and linked to an antenna on the circuit board or other substrate of the host electronic device. Alternatively, pads 235A and 236A may be individually connected to separate antennas. The other features of filter 200 are substantially the same as in filter 10 as described herein above and are not further described.

EXAMPLE

A filter was simulated according to the embodiment shown in FIGS. 1 and 2 with the design parameters specified in Table I, below.

TABLE I

| | |
|---|---|
| Filter length (side 24 to side 22) | 13.50 mm |
| Filter board height (side 18 to 20) | 2.00 mm |
| Filter width (side 14 to side 16) | 6.50 mm |
| Outgoing (transmit) signal passband | 1850 to 1910 MHz |
| Incoming (receive) signal passband | 1930 to 1990 MHz |

Figure 5:
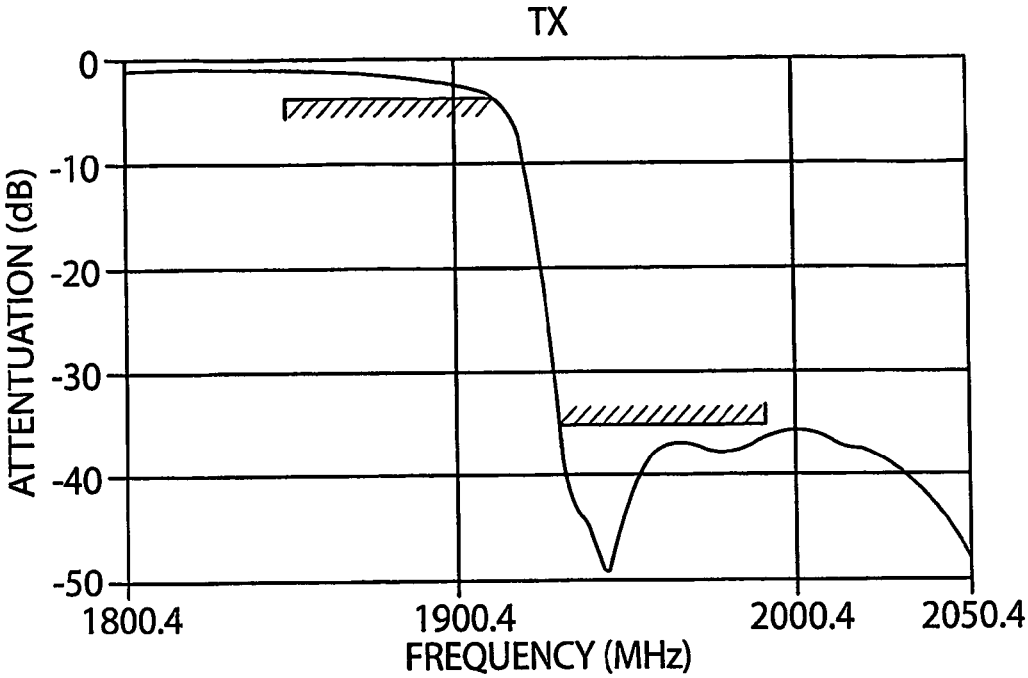
FIG. 5 is a graph of insertion loss versus frequency for a transmit passband of the duplexing filter of FIG. 1.
Figure 6:
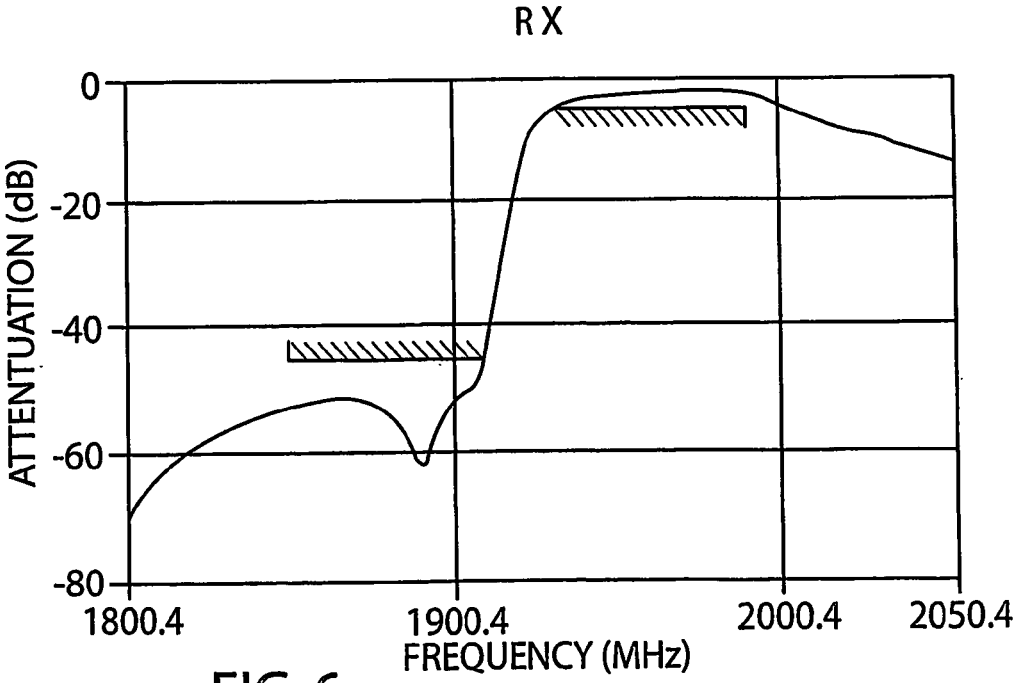
FIG. 6 is a graph of insertion loss versus frequency for a receive passband of the duplexing filter of FIG. 1.

The example filter was simulated using Microwave Office, Applied Wave Research, Inc. (El Segundo, Calif.). FIG. 5 is a type S21 Scattering Parameter result from the simulation for the transmit section. The filter exhibited a maximum insertion loss for the desired transmit frequency band of about 3.3 dB. FIG. 6 is a type S21 Scattering Parameter result from the simulation for the receive section. The filter exhibited a maximum insertion loss for the desired receive frequency band of about 4.6 dB.

S-parameters are ratios of reflected and transmitted traveling waves measured at specified component connection points. An $S_{21}$ data point or plot is a measure of insertion loss, a ratio of an output signal at an output connection to an input signal at an input connection, at one or a range of input signal frequencies. For a discussion of Scattering Parameters and associated test standards and equipment, please consult the following references: Anderson, Richard W. "S-Parameter Techniques for Faster, More Accurate Network Design," *Hewlett-Packard Journal*, vol. 18, no. 6, Feb. 1967; Weinert, "Scattering Parameters Speed Design of High Frequency Transistor Circuits," *Electronics, vol.* 39, no. 18, Sep. 5, 1986; or Bodway, "Twoport Power Flow Analysis Using Generalized Scattering Parameters," *Microwave Journal*, vol. 10, no. 6, May 1967.

The simulated duplexer exhibited a significant improvement in attenuation at the target frequencies and only minor signal losses in the transmit and receive passbands. It provides a lower profile RF filter with low maximum insertion loss in the passband as well as a sharp transition to the stopbands.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

I claim:

1. A communication filter comprising:

a dielectric block having a first and a second end portion and a central portion therebetween, the dielectric block having a top surface, a bottom surface and a plurality of through-holes each extending between an opening on the top surface and an opening on the bottom surface;

a first and a second antenna coupling area located on the top surface of the block;

a transmitter coupling pad on the block;

a receiver coupling pad on the block;

a plurality of coupled resonators provided by a first set of the plurality of through-holes and extending through the block between the top and bottom surfaces a trap resonator provided by at least one of the plurality of through-holes and extending through the block between the top and bottom surfaces and located in the central portion between the first and the second antenna coupling areas, the trap resonator providing attenuation outside of a desired passband; and a decoupler provided by at least a second one of the plurality of through-holes and extending through the block between the top and bottom surfaces and located in the central portion. the trap resonator being located between the decoupler and one of the first and second antenna coupling areas.

2. The communication filter according to claim 1 further comprising a second trap resonator extending through the block between the top and bottom surfaces and located at the first end portion.

3. An antenna duplexer comprising:

a dielectric block having a first, a second and a third set of paired opposed sides and a central portion;

a first and a second antenna coupling electrode located on the dielectric block in the central portion;

a first section of the block extending between the first antenna electrode and a first end of the block;

a second section of the block extending between the second antenna electrode and a second end of the block, the second end opposing the first end, each of the first and second sections having a plurality of coupled resonators extending between the first set of paired opposed sides, the plurality of coupled resonators being defined by a plurality of metallized through-holes extending between the first set of paired opposed sides;

a decoupler located in the central portion of the dielectric block and being defined by one of the plurality of metallized through-holes extending between the first set of paired opposed sides, the decoupler further being located between the first and second antenna coupling electrodes; and a relatively expansive metallized area located on the block for providing a reference potential, the block further comprising a metallization extension on one of the sides of the first set of paired opposed sides, the metallization extension extending between the decoupler and the relatively expansive metallized area.

4. A communication signal filter comprising:

a core of dielectric material having a first end, a second end, a top surface, a bottom surface, first side and second side, the core further having a plurality of through-holes, each of the through-holes extending between an opening on the top surface and an opening on the bottom surface;

a plurality of metallized areas on the core including, a first input-output coupling area located on the top surface and extending onto the first side, a second input-output coupling area located on the top surface and extending onto the first side, the second input-output coupling area being spaced apart from the first input-output coupling area along a length of the core between the first and second ends, the first and second input-output coupling areas defining respective first and second antenna coupling areas, a third input-output coupling area on the top surface and extending onto the first side and positioned between the first input-output coupling area and the first end, a fourth input-output coupling area on the top surface and extending onto the first side and positioned between the second input-output coupling area and the second end, wherein the core and the plurality of metallized areas together define at least one trap resonator positioned between the first input-output coupling area and the second input-output coupling area, the trap resonator being defined by at least one of the plurality of through-holes extending between the top surface and the bottom surface.

5. A communication signal filter comprising:

a core of dielectric material having a first end, a second end, a top surface, a bottom surface and defining a plurality of through-holes, each of the through-holes extending between an opening on the top surface and an opening on the bottom surface;

a plurality of metallized areas on the core including, a receiver coupling area, a transmitter coupling area spaced apart from the receiver coupling area along a length of the core between the first and second ends, a first antenna coupling area positioned between the receiver coupling area and the transmitter coupling area, a second antenna coupling area positioned between the receiver coupling area and the transmitter coupling area, a relatively expansive area, wherein at least one of the plurality of through-holes is positioned between the first and second antenna coupling areas to define a first trap resonator; and a decoupler positioned between the first and second antenna coupling areas, the decoupler being defined by another of the plurality of through-holes. the other of the plurality of through-holes defining the decoupler having a metallized sidewall conductively connected to the relatively expansive area at both the top surface and the bottom surface.

6. The filter of claim 5 wherein at least another of the plurality of through-holes is positioned between the first end of the block and the transmitter coupling area to define a second trap resonator.

7. The filter of claim 5 wherein at least another of the plurality of through-holes is positioned between the second end of the block and the receiver coupling area to define a third trap resonator.

8. In a communication filter including a plurality of coaxial resonators provided in a monoblock having a first set of metallized through-holes extending through the filter between opposed top and bottom surfaces and a metallization pattern, the monoblock having first and second ends and a central portion, the improvement which comprises:

a first and a second antenna coupling metallized area in the central portion;

a decoupler positioned between the first and the second antenna coupling metallized areas, the decoupler being provided by a second metallized through-hole extending between the top and bottom surfaces of the filter;

and a first trap resonator positioned between one of the first and the second antenna coupling metallized areas in the central portion and the decoupler, the first trap resonator being formed by a third metallized through-hole extending between the top and bottom surfaces of the filter.

9. The communication filter of claim 8 wherein a fourth metallized through-hole is positioned between the first end of the block and a transmitter coupling area to define a second trap resonator.

10. The communication filter of claim 8 wherein a fifth metallized through-hole is positioned between the second end of the block and the receiver coupling area to define a third trap resonator.

11. The communication filter of claim 8 wherein a sixth metallized through-hole defines a fourth trap resonator positioned between the other of the first and second antenna coupling metallized areas in the central portion and the decoupler.

12. The communication filter of claim 8 further comprising a metallization pattern extension extending between the decoupler and the metallization pattern.

* * * * *